United States Patent [19]

MacKay et al.

[11] 4,064,382

[45] Dec. 20, 1977

[54] IGNITION DISTRIBUTOR BREAKER CONTACT POINT SET HAVING GROUNDING STRAPS DISPOSED BETWEEN CAPACITOR AND CONTACT TERMINAL

[75] Inventors: John A. MacKay, New Baltimore; George M. Gilkey, Farmington, both of Mich.

[73] Assignee: Gulf & Western Manufacturing Company, Southfield, Mich.

[21] Appl. No.: 706,651

[22] Filed: July 21, 1976

[51] Int. Cl.[2] ..... H01H 19/00; F02P 3/00

[52] U.S. Cl. ..... 200/19 R; 200/19 A; 220/30 A; 200/31 A; 123/146.5 A

[58] Field of Search ..... 200/19 R, 19 A, 19 DC, 200/19 DR, 30 R, 30 A, 30 AA, 31 R, 31 A, 31 DP; 123/146.5 A, 148 P, 149 D, 146.5 R

[56] References Cited

U.S. PATENT DOCUMENTS

| | | | |
|---|---|---|---|
| 2,005,806 | 6/1935 | Schwarzmann | 200/30 A |
| 2,240,804 | 5/1941 | Schwarzmann | 200/19 A |
| 2,273,113 | 12/1956 | Alstrom | 200/19 A X |
| 2,786,087 | 3/1957 | McGrevy | 200/31 A X |
| 2,835,755 | 5/1958 | Filko | 200/31 A X |
| 3,091,672 | 5/1963 | Longenecker | 200/31 A |
| 3,646,301 | 2/1972 | Huntzinger et al. | 200/19 A X |
| 3,908,102 | 9/1975 | Seike | 200/19 A |
| 4,005,294 | 1/1977 | Brayley et al. | 200/19 A |

*Primary Examiner*—James R. Scott

*Attorney, Agent, or Firm*—Gregory J. Battersby; Thomas E. Harrison, Jr.; Kenneth E. Merklen

[57] ABSTRACT

An improved ignition distributor breaker contact point set is provided which includes an electrically conductive plate member including a first breaker contact in electrical contact with the plate member; an electrically conductive, pivotably mounted breaker arm having at one end thereof a second breaker contact, the breaker arm being spring loaded by affixation to an electrically conductive leaf spring; and a condensor having a first electrically conductive terminal in electrical contact with said plate member and a second electrically conductive terminal which is insulated from said plate member. An electrically conductive, elongated support strap is provided, said support member spanning directly between and physically and electrically connecting the second electrically conducting terminal of the condensor and the leaf spring art.

6 Claims, 6 Drawing Figures

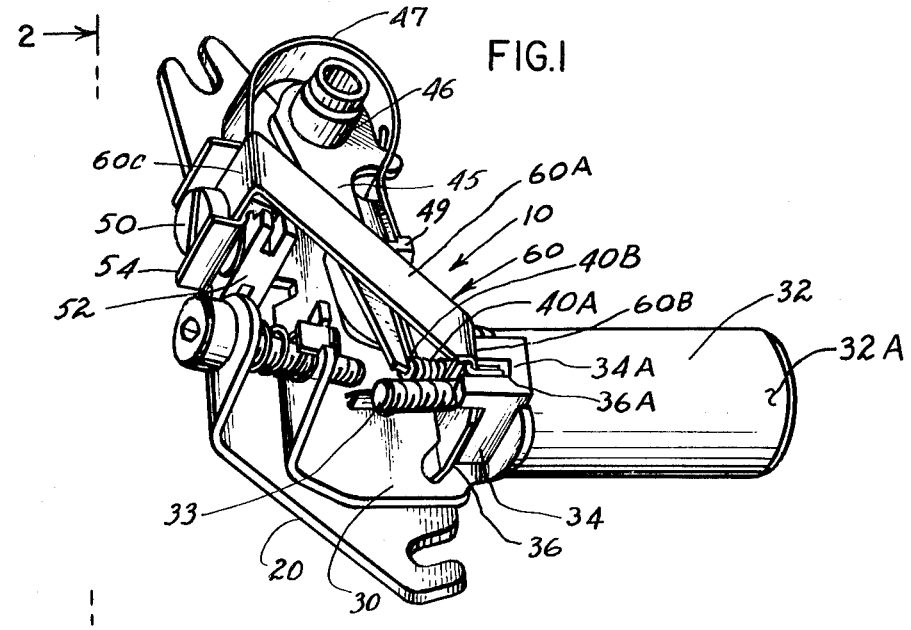
FIG.1
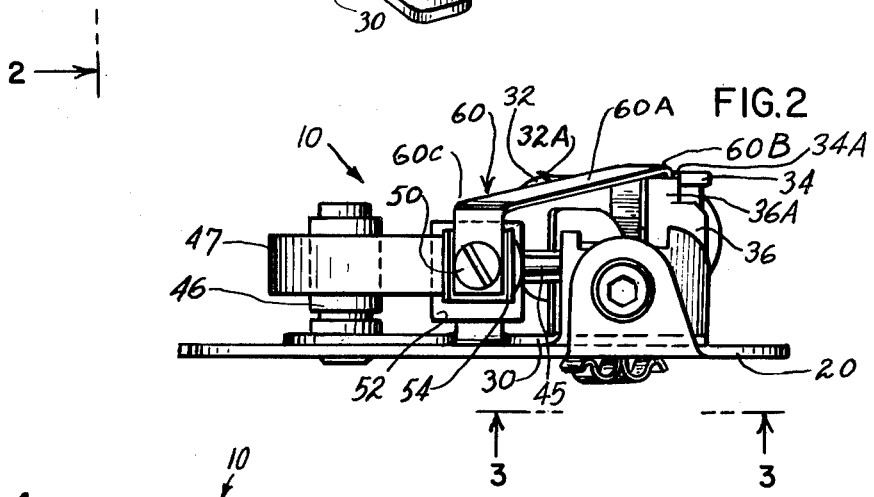
FIG.2
FIG.4
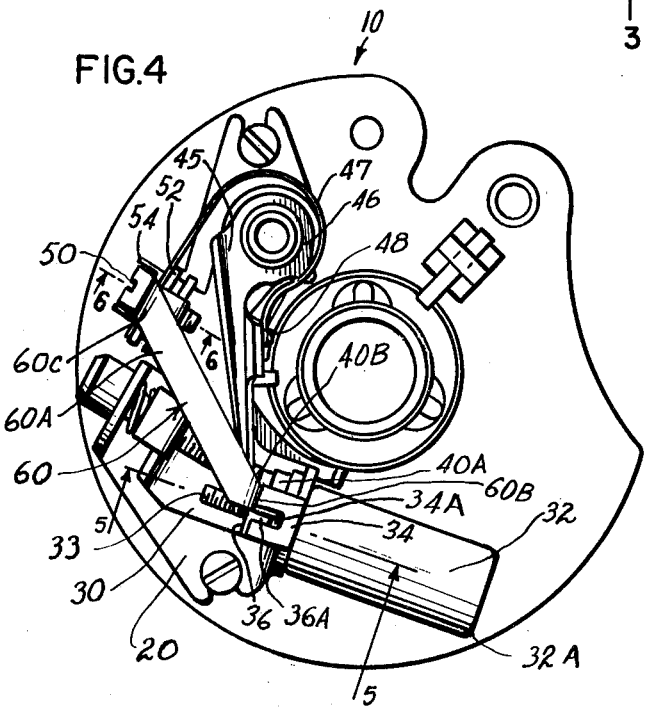
FIG.3
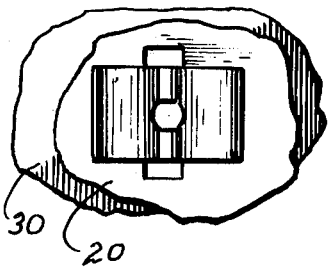

IGNITION DISTRIBUTOR BREAKER CONTACT POINT SET HAVING GROUNDING STRAPS DISPOSED BETWEEN CAPACITOR AND CONTACT TERMINAL

BACKGROUND OF THE INVENTION

The present invention relates generally to an ignition distributor breaker contact point set and, more particularly, to a breaker point set which produces a minimal amount of radio frequency interference and which is less subject to pre-mature failure than low radio frequency interference breaker point sets heretofore employed.

It has been discovered that a particular type of radio frequency interference is inherently generated by most distributor breaker contact point sets. This is principally due to the fact that during operation, arcing is occasionally experienced between the contacts thus providing a path for the discharge of the energy stored in the condensor. It is this discharge which results in a "popping" or "cracking" type of radio frequency interference. This problem is particularly acute in breaker point sets in which the condensor is connected to the contact spring and contact arm by a circular lead which, in fact, functions as a rather effective radiating antenna.

The problem of radio frequency interference was minimized by breaker point sets which position the condensor in electrical contact with a slotted conductive tab member to which is secured a breaker contact. Such a breaker point set is described in U.S. Pat. No. 3,646,301 which issued on Feb. 29, 1972 to Gerald O. Hutzinger et al. The breaker point set disclosed in the Hutzinger et al. patent employs an elongated strip of electrically conductive material connecting the breaker arm to the electrically conductive post of the condensor. The contact points engage one another through a longitudinally extending slot in this strip which is positioned parallel to the breaker arm. While this design effectively minimizes radio frequency interference, due to its provision of a direct outlet for the discharge current from the condensor in the event of arcing between the contact points and its providing loops of minimal area and of opposite polarity, the breaker point set presents certain inherent design disadvantages. For example, the provision of having the contact points engage and disengage through a longitudinal slot in the strip of electrically conductive material may result in premature failure should the strip become displaced and thus result in the shorting out of the contacts. Additionally, the positioning of the elongated strip substantially parallel to the breaker arm fails to provide sufficient support for the breaker point set and, in particular, the condensor.

Against the foregoing background, it is a primary objective of the present invention to provide an ignition distributor breaker contact point set which minimizes radio frequency interference and which is resistant to premature failure due to shorting out of the contacts.

It is another object of the present invention to provide an ignition distributor breaker contact point set which provides adequate support for the condensor.

SUMMARY OF THE INVENTION

To the accomplishment of the foregoing objects and advantages, the present invention briefly comprises an improved ignition distributor breaker point set of the type having an electrically conductive plate member which includes a first breaker contact in electrical contact with the plate member; an electrically conductive, pivotably mounted breaker arm including at one end thereof a second breaker contact adapted to electrically engage the first breaker contact, said breaker arm being spring loaded by affixation to a leaf spring connected at one end to said breaker arm by a rivet and connected at its other end to the plate member by a securing screw; and a condensor having a first electrically conductive terminal in electrical contact with the plate member and a second electrically conductive terminal which is insulated from the plate member. An electrically conductive, elongated support member is provided spanning directly between and electrically connecting the second electrically conductive terminal and the electrically conductive leaf spring at its said other end.

BRIEF DESCRIPTION OF THE DRAWINGS

The foregoing and still other objects and advantages of the present invention will be more apparent from the following detailed explanation of the invention in connection with the accompanying drawings wherein:

FIG. 1 illustrates in perspective form the breaker point set of the present invention;

FIG. 2 is an end view of the breaker point set of the present invention;

FIG. 3 is a partial bottom view taken along line 3—3 of FIG. 2;

FIG. 4 is a top plan view of the breaker point set of the present invention as it is mounted on the distributor of an automobile;

DESCRIPTION OF THE PREFERRED EMBODIMENTS

Figure 5:
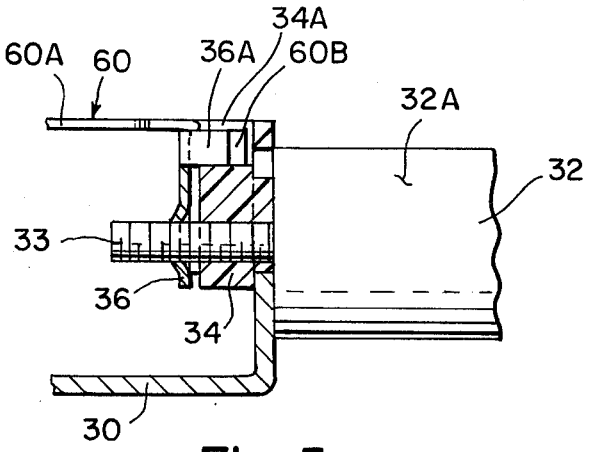
FIG. 5 is a cross-sectional view taken along line 5—5 of FIG. 4.
Figure 6:
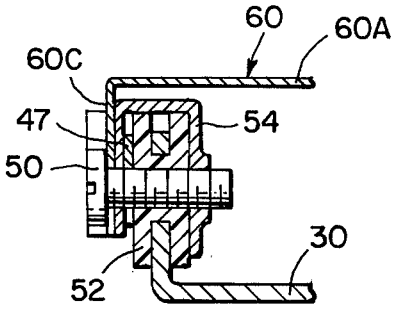
FIG. 6 is a cross-sectional view taken along line 6—6 of FIG. 4.

Referring now to the drawings and, in particular, FIGS. 1 and 2, there is shown the breaker point set of the present invention referred to generally by reference numeral 10. The breaker point set 10 includes a generally planar support plate member 20 fabricated from an electrically conductive material.

An electrically conductive mounting plate 30, having, at one end, a generally U-shaped configuration, is secured to the plate member 20 and is adapted to receive for mounting the individual elements of the breaker point set 10. A condensor 32, having an electrically conductive outer casing 32A and a partially threaded, electrically conductive post 33 extending from one end thereof, is mounted at one end of the mounting plate 30 by the insertion of the post 33 through an aperture in the mounting plate 30. The electrically conductive outer casing 32A of the condensor 32 is in electrical contact with the mounting plate 30 and thus provides a first electrically conductive terminal for the condensor 32. A block of insulating material 34 including an aperture which extends through the thickness of block 34 is provided and is mounted on the mounting plate 30 such that the aperture of the block 34 is in axial alignment with the aperture of the mounting plate 30 thus permitting the post 33 of the condensor 32 to be inserted through these apertures and be threadably secured therein by an electrically conductive fastening member 36 including an upswept portion 36A. This serves to provide a second electrically conductive terminal for the condensor 32 which is insulated from the first electrically conductive terminal by the block of insulating material 34. A slot 34A is provided on the block 34 and is adapted to receive the upswept portion 36A of the fastening member 36.

One of a pair of contact points 40A is provided on the condensor mounting plate 30 in electrical contact with the outer casing 32A of the condensor 32 through the mounting plate 30. The other one of said pair of contact points 40B is provided at the end of an electrically conductive breaker arm 45 which is pivotably mounted on pivot 46 which serves to also connect the other end of the mounting plate 30 to the support plate member 20. The breaker arm is spring loaded by leaf spring 47, one end of which is secured to the breaker arm by a rivet 48 and the other end of which passes around the pivot 46 and is secured to a portion of the mounting plate by a securing screw 50 and an insulating block 52. A generally U-shaped mounting bracket 54 is provided about the insulating block 52 and the end of the leaf spring 47 and is in electrical contact with the spring 47.

A rubbing block 49 is provided on the breaker arm 45 and is secured thereto by the rivet 48. The rubbing block 49 is adapted to engage the breaker cam of the distributor to alternately open and close the contact points 40A and 40B as the cam rotates during operation of the engine.

An elongated support strap 60 fabricated from an electrically conductive material such as, for example, phosphor bronze, is provided to directly span and physically and electrically connect the post 33 of the condensor 32 to the securing screw 50. Support strap 60, includes an elongated center portion 60A and two end portions 60B and 60C which extend angularly, preferably at right angles, from the elongated center portion 60A. Elongated center portion 60A may be solid or, in an alternate embodiment, may include a slot which extends along substantially its entire longitudinal extent. As shown in FIG. 5. the support strap 60 is secured to the breaker point set 10 by insertion of one of the end portion 60B into the slot 34A of the insulating block 34 where electrical contact is established with the post 33 of the condensor 32 through with the upswept portion 36A of the fastening member 36. The other of the two end portions 60C, which includes a slotted portion, is securably affixed to the mounting bracket 54 and spring 47 by insertion of the screw 50 through the slotted portions of said other end portion 60C, the mounting bracket 54 and spring 47. As such, the support strap 60 is electrically connected to the leaf spring 47 through the securing screw 50 and the U-shaped mounting bracket 54.

It will be appreciated that the support strap 60 extends directly from the condensor 32 and the insulating block 34 to the securing screw 50 which is in electrical contact through the leaf spring 47 to the breaker arm 45 and the contact points 40A and 40B and is thus independent of the engaging and disengaging of the contact points 40A and 40B. This assures that any displacement of the support strap 60 will not result in a possible shorting of the contact points 40A and 40B. Additionally, the positioning of the support strap 60 directly between the condensor 32 and the securing screw 50 serves to provide improved support for the breaker point set 10. Further, the support strap 60 effectively minimizes radio frequency interference since, in the event that an arc should develop across contact points 40A and 40B, the resultant discharge current from the condensor 32 would travel from the electrically conductive post 33 of the condensor 32, through the support strap 60 to the securing screw 50 and the leaf spring 47. Similarly, the arc between the contacts 40A and 40B would travel directly to the condensor 32 and its electrically conductive outer casing 32A through the mounting plate 30. This dual loop discharge circuit, being of relatively small dimension, is effective in reducing radio frequency interference since the magnetic fields generated by each of these circuits will effectively cancel each other out.

Having thus described the invention with particular reference to the preferred froms thereof, it will be obvious that various changes and modification may be made therein without departing from the spirit and scope of the invention as defined by the appended claims.

What is claimed is:

1. An improved ignition distributor breaker contact point set of the type having an electrically conductive plate member which includes a first breaker contact mounted on said plate member; an electrically conductive, pivotably mounted breaker arm electrically insulated from said plate member and including at one end thereof a second breaker contact adapted to physically and electrically engage the first breaker contact, said breaker arm being spring loaded by affixation to one end of an electrically conductive leaf spring, which is releasably secured at its other end to said plate member and is insulated therefrom and a condensor slidably mounted on said plate member, said condensor having a first electrically conductive terminal in physical and electrical contact with said plate member and a second electrically conductive terminal insulated from said plate member, wherein said improvement comprises an electrically conductive elongated support strap having an elongated center portion and two end portions each extending angularly from said center portion, said strap spanning directly between and electrically connecting the second electrically conductive terminal of said condensor and said electrically conductive leaf spring at said other end.

2. The distributor breaker point set of claim 1 wherein said other end of the leaf spring is physically secured to said plate member and said support strap by a securing screw and wherein said leaf spring, said support strap and said securing screw are insulated from said plate member by insulation means.

3. The distributor breaker point set of claim 2 wherein the second electrically conductive terminal of said condensor is insulated from the plate member by a block formed from insulating material, said block including a slot adapted to receive one of the two angularly extending end portions of said elongated support member to establish electrical contact with the second electrically conductive terminal of said condensor.

4. The distributor breaker point set of claim 3 wherein said first electrically conductive terminal comprises the outer casing of said condensor and wherein said second electrically conductive terminal comprises a threaded post extending from said condensor.

5. The distributor breaker point set of claim 3 wherein electrical contact is established between one of the two angularly extending end portions of said support member and the second electrically conductive terminal of said condensor through an electrically conductive fastening member 6. The distributor breaker point set of claim 1 wherein said elongated support strap includes a slot which extends along substantially the entire longitudinal extend of the strap.

* * * * *